United States Patent [19]

Corto et al.

[11] Patent Number: 4,582,115

[45] Date of Patent: Apr. 15, 1986

[54] DEVICE AND PROCEDURE FOR MECHANICAL INSERTION OF A GRADE SEPARATOR IN CONTINUOUS STEEL CASTING

[75] Inventors: Frank J. Corto, Timonium, Md.; Mustafa R. Ozgu; Manfred Schmidt, both of Bethlehem, Pa.

[73] Assignee: Bethlehem Steel Corporation, Bethlehem, Pa.

[21] Appl. No.: 616,872

[22] Filed: Jun. 4, 1984

[51] Int. Cl.[4] ..... B22D 11/00

[52] U.S. Cl. ..... 164/459; 164/412; 164/418

[58] Field of Search ..... 164/412, 418, 459, 461

[56] References Cited

U.S. PATENT DOCUMENTS

| | | | |
|---|---|---|---|
| 1,885,398 | 11/1932 | Wilson et al. | 29/250 |
| 3,789,911 | 2/1974 | Bachner | 164/459 |
| 4,250,945 | 2/1981 | Koshikawa et al. | 164/461 |
| 4,269,257 | 5/1981 | Ohzu et al. | 164/461 |
| 4,496,457 | 1/1985 | Schickel | 209/232 |

FOREIGN PATENT DOCUMENTS

| | | | |
|---|---|---|---|
| 55-33872 | 3/1980 | Japan | 164/459 |
| 56-131050 | 10/1981 | Japan | 164/461 |
| 57-25256 | 2/1982 | Japan | 164/461 |

*Primary Examiner*—Nicholas P. Godici
*Assistant Examiner*—Richard K. Seidel
*Attorney, Agent, or Firm*—John F. Lushis, Jr.

[57] ABSTRACT

A device and method for the insertion of commercial grade separators into the mold of a continuous steel caster. The present invention discloses a device made from standard steel channel and a method for the use thereof to mechanically insert grade separators.

8 Claims, 10 Drawing Figures

DEVICE AND PROCEDURE FOR MECHANICAL INSERTION OF A GRADE SEPARATOR IN CONTINUOUS STEEL CASTING

BACKGROUND OF THE INVENTION

A continuous steel caster is a machine that transforms or casts molten steel into solidified semi-finished shapes such as billets, blooms, and slabs. Specifically, molten steel from a steelmaking furnace, usually a basic oxygen furnace, is poured into a trough-shaped container called a tundish. The tundish is placed over a device which sizes and shapes the steel known as the caster mold. Steel from the tundish is poured into the mold through an an apparatus known as a tundish shroud. As the molten steel flows out of the mold, the steel takes the form of a strand and is moved through cooling devices by an array of motorized rollers. Thus, a continuous supply of molten steel to the caster will allow steel to be cast without interruption. Many continuous casters are constructed with multiple molds so that several strands of steel can be cast simultaneously.

Manufacturing requirements often mandate that several grades of steel, that is, steels having different metallurgical properties, be continuously cast. Usually, when a different grade of steel is to be cast, the caster must be emptied of the steel previously cast before the different grade of steel can be poured. This creates an interruption in the casting process resulting in a loss of production time.

In an attempt to eliminate the loss of down time incurred between the casting of different grades of steel in a continuous casting process, efforts have been made to sequentially cast such different grades of steel. Sequential casting, however, usually lowers the yield of marketable steel because the mixing of the two different grades of steel in and below the caster mold creates a lengthy transition zone of chemically non-uniform material. Recent efforts to minimize the amount of mixing between two grades of steel have resulted in the use of various types of metallic devices commonly called grade separators which, when inserted into a mold filled with molten steel, act as cooling devices and precipitate the formation of a solidified barrier between the two grades of molten steel. Such devices have been disclosed in U.S. Pat. No. 4,250,945 and U.S. Pat. No. 4,269,257. This solidified barrier greatly reduces the amount of mixing between the two different grades of steel while eliminating much of the down time previously incurred when casting different grades of steel without grade separators.

A problem that arises, however, from the use of grade separating devices is the potential safety hazards encountered when inserting such devices into a caster mold. Although the grade separators can be inserted manually, safety regulations and requirements often prohibit manual insertion. Furthermore, manual insertion creates a timing problem. The grade separator should be inserted during the time a tundish is replaced with another tundish containing a different grade of steel and prior to any solidification in the caster mold of the horizontal end surface of the molten steel strand. If a continuous caster is constructed to cast multiple strands of steel simultaneously, the amount of time necessary to manually insert several grade separators into the caster mold will prohibit the completion of the insertion procedure during the time tundishes are being changed unless additional labor is used. Without such additional labor, the casting process would be delayed until the insertion procedure is completed. Thus, both safety and time considerations mandate that grade separators be inserted by non-manual methods.

SUMMARY OF THE INVENTION

It is, therefore, an object of this invention to provide a device which will facilitate the mechanical insertion of grade separators into the mold of a continuous caster.

It is also an object of this invention to provide a method for using the device which requires only a minimal number of workers.

The present invention accomplishes these objectives by providing two suspension bridge-type devices made from standard U-shaped channel and affixed to each end of the grade separator by wire rope. T-shaped pushers are inserted into support brackets welded to the bottom of a continuous caster tundish. As the caster tundish is lowered, the T-shaped pushers come into contact with the grade separator causing the separator to be inserted uniformly and straight into the caster mold. A friction clamp for the wire rope is affixed to each suspension bridge. The clamp, acting in conjunction with a spring-loaded plunger, can be adjusted to hold the grade separator under its own weight but still allow for slippage of the wire rope when additional pressure is exerted by the T-shaped pushers on the grade separator.

PREFERRED EMBODIMENT

Figure 2:
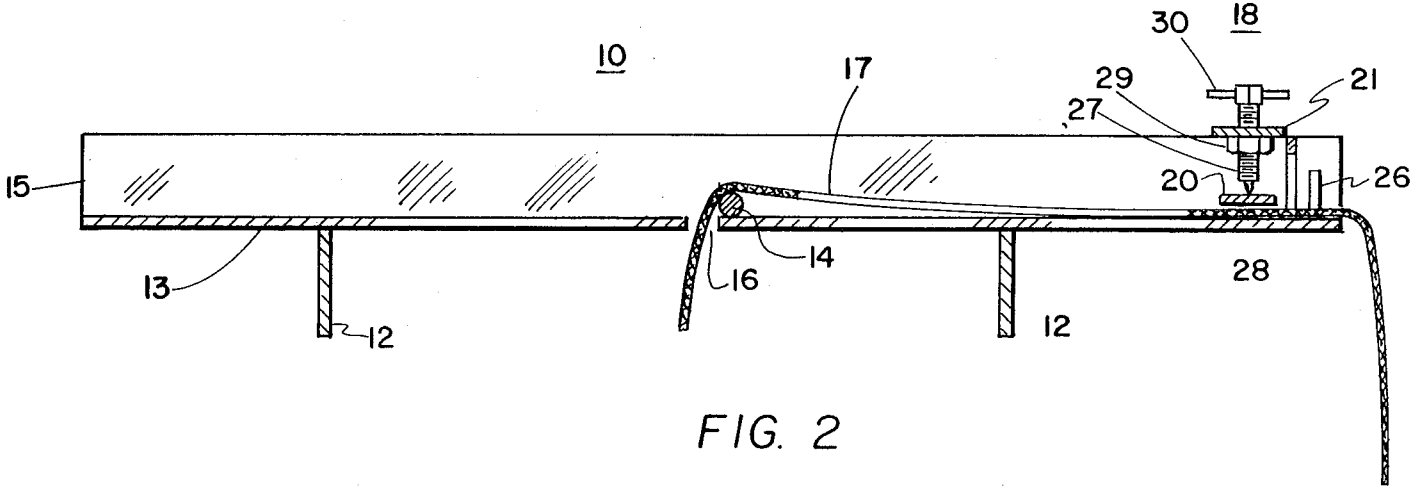
FIG. 2 is a cross-sectional view of the insertion type device taken on line 2—2 of FIG. 1.
Figure 1:
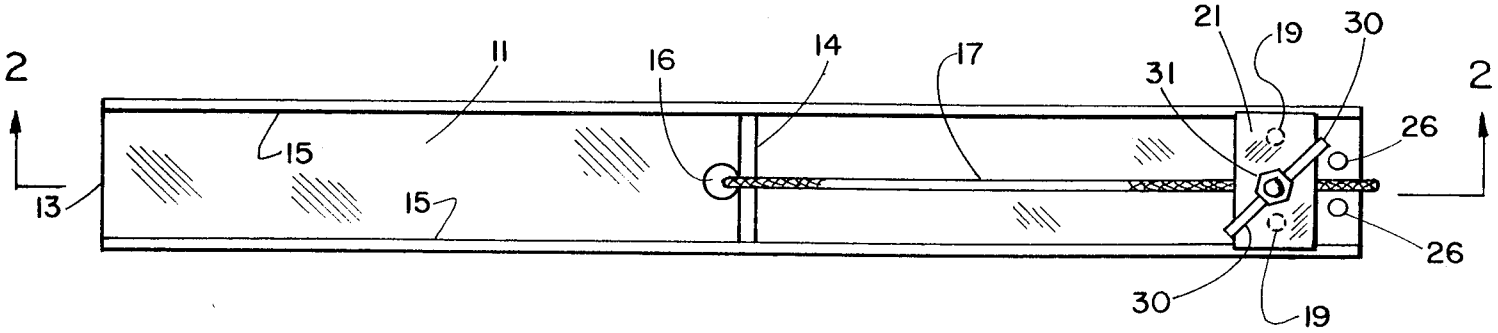
FIG. 1 is a plan view of the insertion device of this invention.
Figure 3:
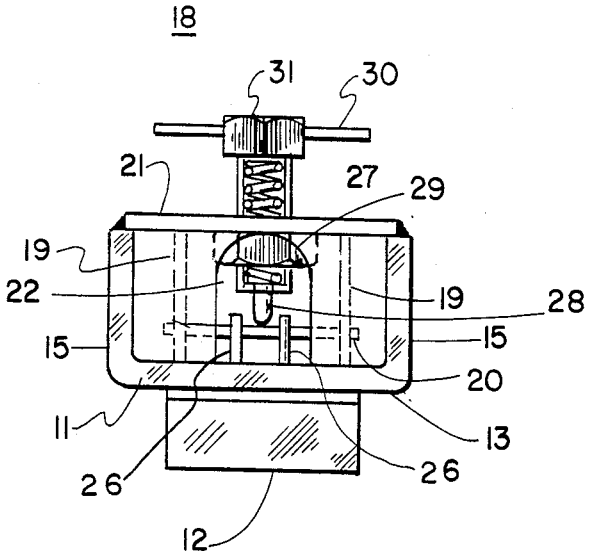
FIG. 3 is an enlarged view of the friction clamp attached to the insertion device of this invention.

Referring now to the drawings and particularly to FIGS. 1, 2 and 3 for a detailed description of the invention, suspension bridge 10 is seen to comprise generally standard U-shaped channel 11 having a hole 16 in the base 13 of channel 11 at approximately the center point between the ends of channel 11. Alignment plates 12 made from angle steel are welded to the outside of base 13 of bridge 10. Cylindrical steel bar 14 having a diameter of ⅜ of an inch or other suitable diameter is welded to sides 15 of bridge 10 near hole 16. Steel wire rope 17 having a length of at least three feet and a nonmetallic core is inserted through hole 16 and over bar 14 and is attached to bridge 10 by means of friction clamp 18. Friction clamp 18 comprises (i) two cylindrical guide bars 19 welded to the inside of base 13 of channel 11, (ii) pressure plate 20 having holes therein so that pressure plate 20 may be positioned on guide bars 19 and (iii) angle plate 21 welded to sides 15 of channel 11 having an inverted U-shaped hole 22 in its vertical side and a round hole in its horizontal side. Wire rope 17 is inserted under pressure plate 20 between guide bars 19 and between guide bars 26 which are welded to the inside of bars 13 of channel 11. Spring plunger 27 is a threaded bolt containing spring 27A which is in contact with nipple-shaped end 28. Spring plunger 27 is inserted through the round hole in the top of angle plate 21 and threaded through nut 29 which is welded to the underside of the top of angle plate 21. Spring plunger 27 is turned by means of cylindrical rods 30 which are welded to nut 31 attached to the top end of spring plunger 27. The amount of pressure on pressure plate 20 can be controlled by turning spring plunger 27 so that nipple-shaped end 28 retracts against spring 27A. Because pressure plate 20 is located immediately above wire rope 17, the exertion of pressure on pressure plate 20 will cause pressure plate 20 to move down along guide bars 19 and exert pressure on wire rope 17. Guide bars 19 prevent pressure plate 20 from tilting when pressure is applied thereto and also guide wire rope 17 along the inside of base 13 of channel 11.

Figure 4:
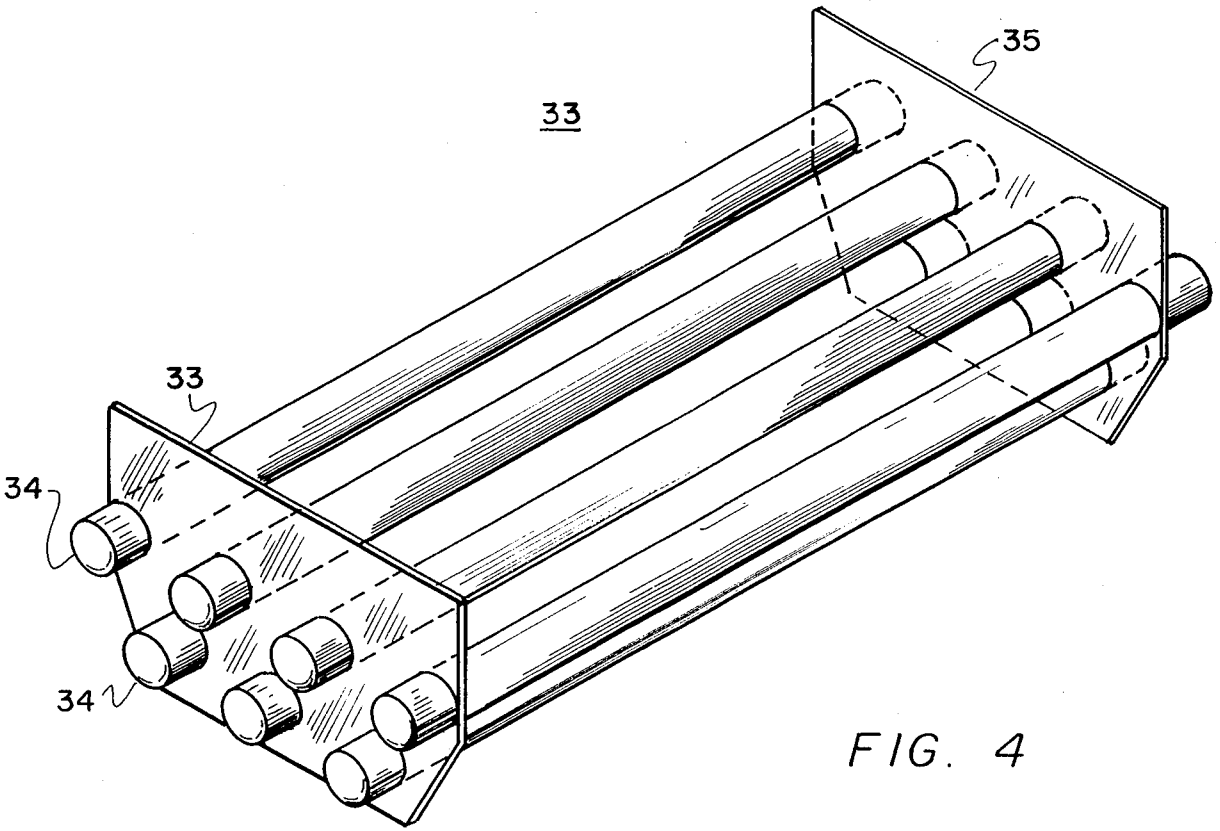
FIG. 4 is a view of the grade separator.

Although bridge 10 can be used to insert any number of devices designed to separate different grades of molten steel in a mold of a continuous caster, reference will be made to the particular device shown in FIG. 4 for purposes of the description of the operation of bridge 10 in this embodiment. FIG. 4 shows grade separator 33 comprising two planes of parallel steel cylindrical bars 34, each bar having a diameter of 1 inch. The number N of bars in the upper plane has been experimentally determined to be the closest integer falling between $$(t-2)/2 \leqq N \leqq (t-1)/2$$

where t is the thickness of the strand in inches. The number of bars in the lower plane is N−1. The length L of each bar in inches has been experimentally determined to be $$W-3 \leqq L \leqq W-1$$

where W is the width of the strand in inches. The distance between the centers of any two bars 34 in the same plane is 2 inches and the center of each bar 34 in the lower plane of bars is equidistant from the centers of the two nearest bars 34 in the upper plane of bars. The alignment of the bars 34 is accomplished by two steel end plates 35 each having a thickness of ½ of an inch and holes therein which coincide with the positions of bars 34. Steel end plates 35 are tack welded to bars 34.

When inserted into a continuous caster mold containing different grades of steel, grade separator 33 will form a solidified barrier between the two different grades of steel. This barrier will minimize the mixing of the two different grades of steel and allow them to be sequentially cast. Grade separator 33 works in a manner similar to the separator devices disclosed in the abovementioned U.S. Pat. Nos. 4,250,945 and 4,269,257.

Figure 5:
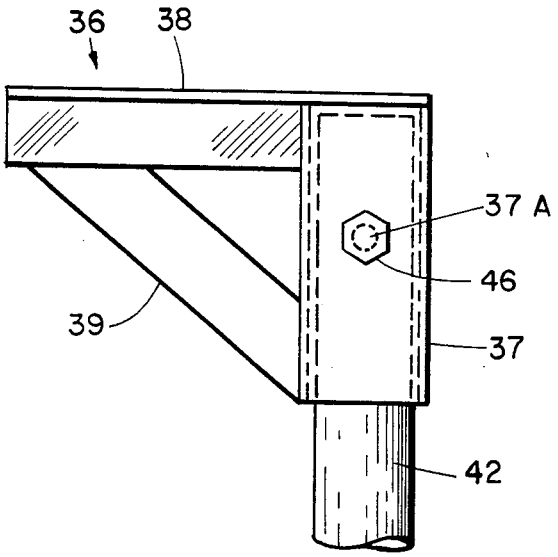
FIG. 5 is an enlarged view of the support brackets attached to the bottom of the tundish.
Figure 6:
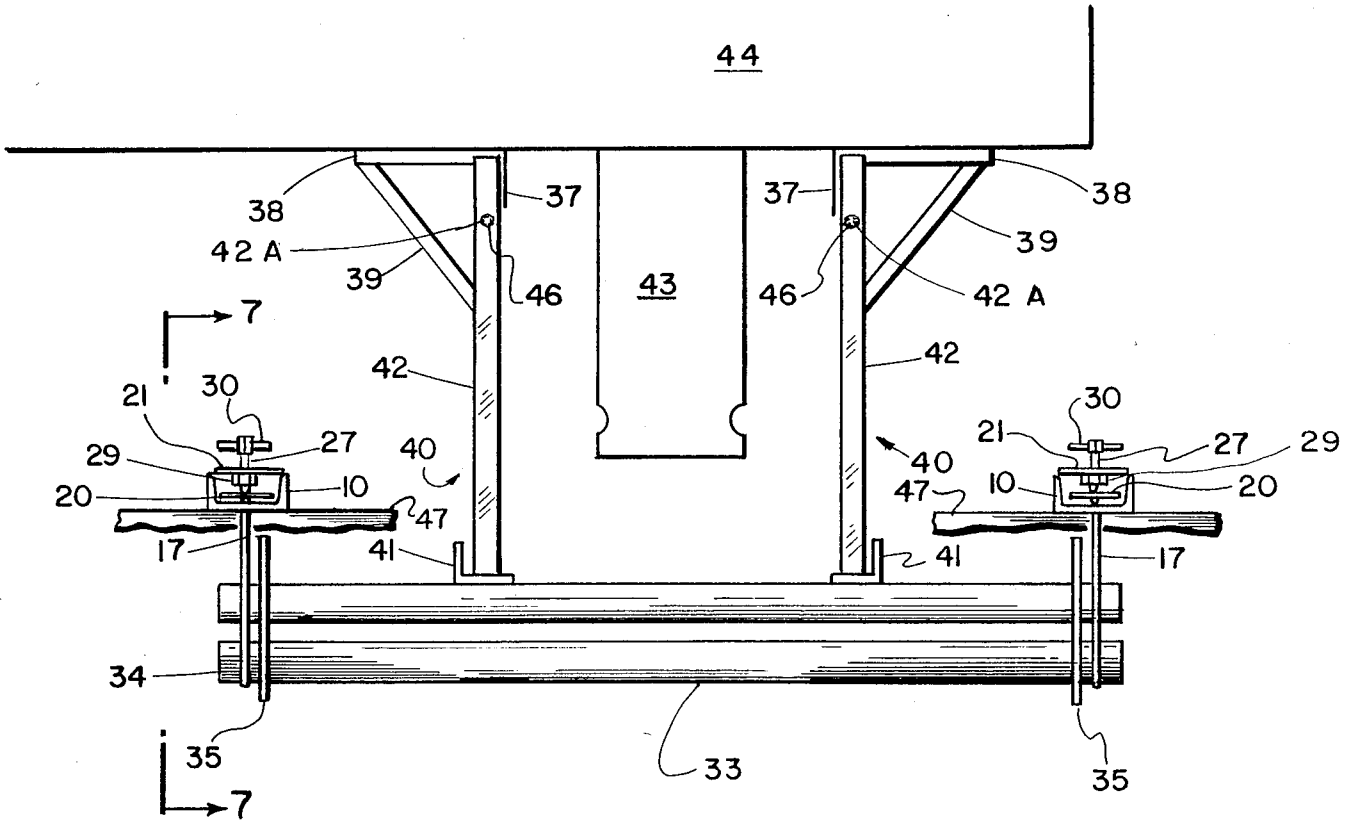
FIG. 6 is a view of the grade separator attached to the insertion devices of this invention shown in conjunction with the T-shaped pushers and the caster tundish.
Figure 8:
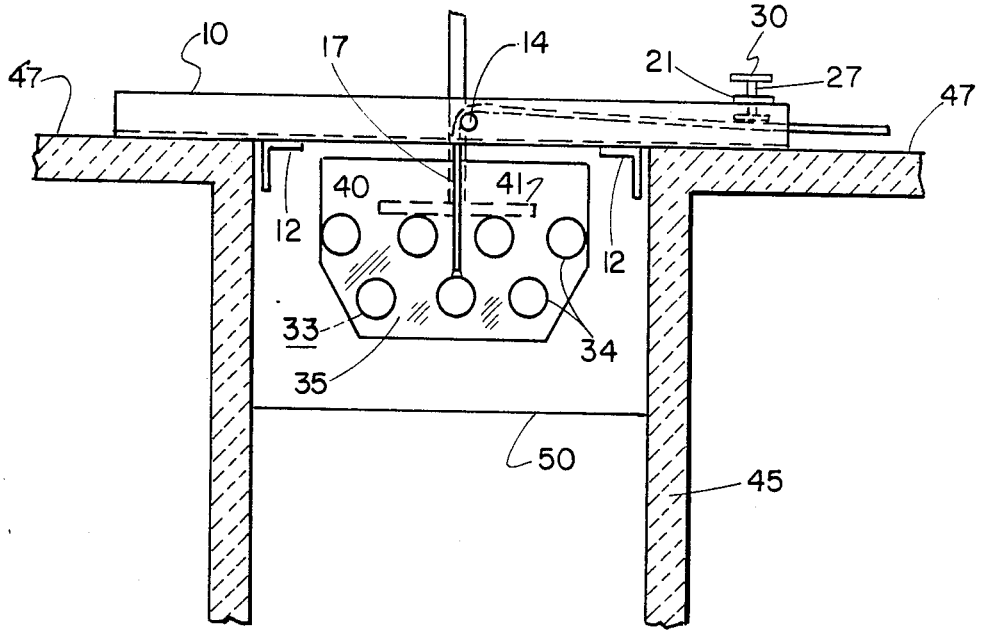
FIG. 8 is a view similar to the view of FIG. 7 subsequent to the insertion of the grade separator into the molten steel in the caster mold.
Figure 7:
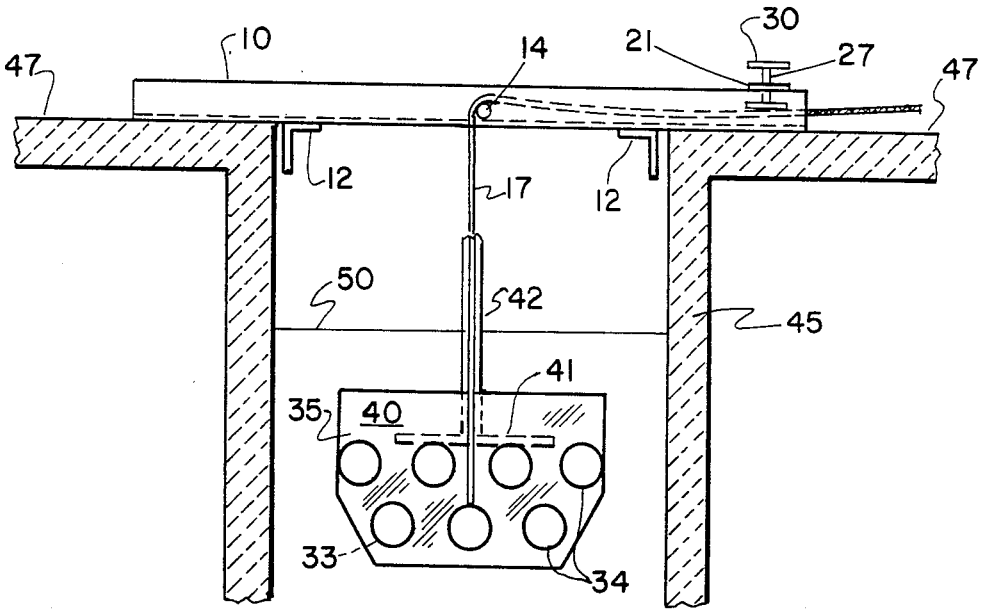
FIG. 7 is a cross-sectional view of the grade separator prior to insertion into the molten steel in the caster mold taken on line 7—7 of FIG. 6.

Referring now to FIGS. 5 and 6, support bracket 36 is shown comprising pipe 37 having a diameter of ¾ of an inch which is attached to angle plate 38 with flat steel member 39 angularly attached to pipe 37 and angle plate 38. Pipe 37 also has hole 37A to accommodate cross bolt 46 or other fastener means. T-shaped pusher 40 comprises cross member 41 made of angle steel attached to bar 42. The length of bar 42 must be such that it extends beyond the length of tundish shroud 43 so as to prevent contact between tundish shroud 43 and grade separator 33. Bar 42 also has hole 42A to accommodate cross bolt 46 or other fastener means. Two support brackets 36 are welded to the bottom of tundish 44 for each strand of steel to be cast e.g., in a two strand caster four brackets are needed. The spacing between T-shaped pushers 40 should be such that they are able to fit into a continuous caster mold without interfering with the operation of tundish shroud 43.

Turning now to the method of inserting grade separator 33 and referring to FIGS. 1 through 8, bridge 10 is attached to the middle bar in the second plane of bars 34 of grade separator 33 by means of wire rope 17. One bridge 10 is attached to each end of grade separator 33. Bridges 10 are then manually placed across mold cover 47 so that grade separator 33 is positioned in the center of the upper part of mold 45. Alignment plates 12 serve as means for centering grade separator 33. This positioning procedure takes approximately 10 seconds and can be performed during the time tundish 44 is being replaced with another tundish containing a different grade of molten steel. Bars 42 of T-shaped pushers 40 are then attached to pipes 37 of support brackets 36 by cross bolts 46 or other fastener means inserted through holes 37A and 42A prior to the time the tundishes are changed. Bridges 10 must not be located below T-shaped pushers 40 in order to prevent an abortion of the insertion procedure and possibly the casting operation.

The lowering of tundish 44 causes T-shaped pushers 40 to force grade separator 33 uniformly and straight into mold 45. Spring plunger 27, acting in conjunction with pressure plate 18, can be turned so that the pressure exerted on wire rope 17 will allow grade separator 33 to be suspended under its own weight prior to insertion into the molten steel 50 in mold 45 and wire rope 17 to slip when additional pressure is exerted on grade separator 33 by T-shaped pushers 40 during the insertion process. Spring plunger 27 and pressure plate 20 also act to prevent grade separator 33 from being inserted into the mold to a depth deeper than the reach of T-shaped pushers 40. A part of wire rope 17 and a portion of T-shaped pushers 40 will melt in molten steel 50 in mold 45. Once the casting process has resumed, bridge 10 can be removed from mold cover 47 manually. Grade separator 33 will become part of the transition zone of the strand of steel.

Alternate Embodiment

Figure 9:
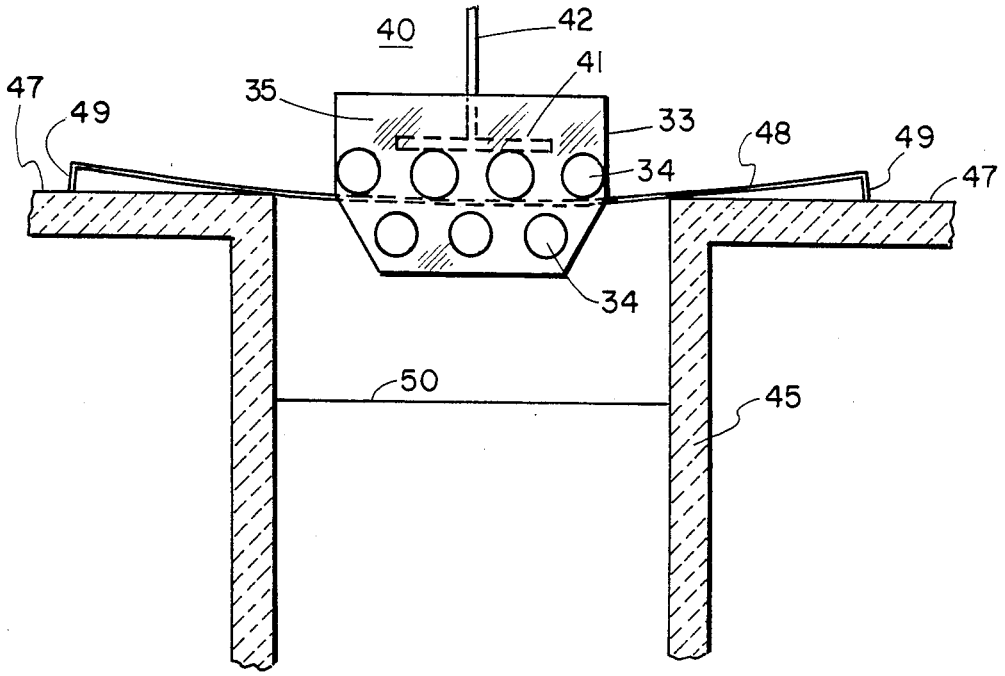
FIG. 9 is a cross-sectional view similar to the view of FIG. 7 of an alternate embodiment of this invention prior to the insertion of the grade separator into the molten steel in the caster mold.
Figure 10:
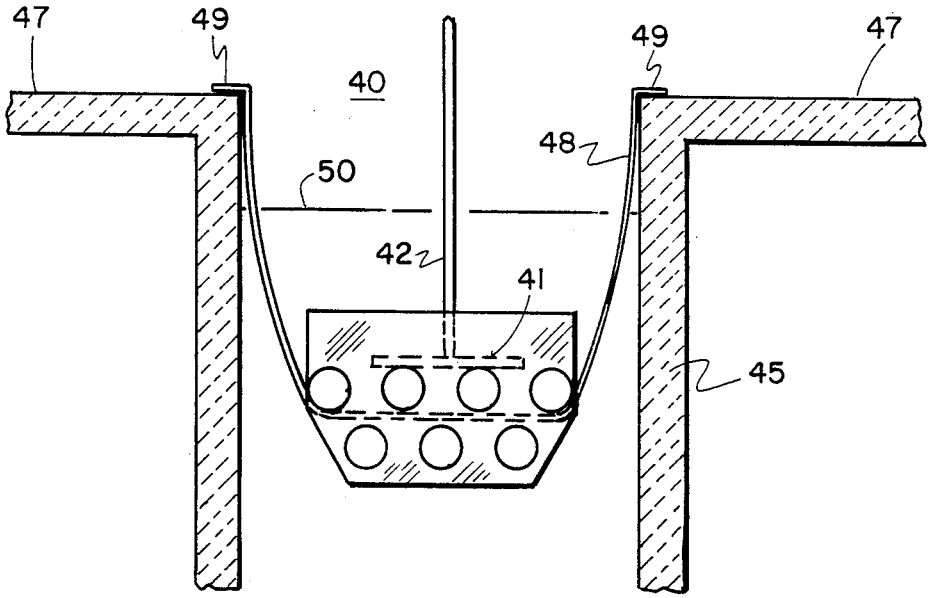
FIG. 10 is a view similar to the view of FIG. 9 subsequent to the insertion of the grade separator into the molten steel in the caster mold.

For an alternative method of mechanically inserting grade separator 33, reference is made to the device shown in FIGS. 9 and 10. Suspension flat 48 is made of plain carbon steel having a width of 1 inch, a thickness of ⅛ of an inch, and an experimentally determined length L where $$L=2\times d+t$$

and d is the immersion depth in inches of the grade separator 33 below the mold cover 47 and t is the thickness of mold 45 in inches. The ends 49 of suspension flats 48 are bent so that two claws are formed which grasp onto mold cover 47. Suspension flat 48 is tack welded to the bottom of two inner bars of the upper plane of cylindrical bars 34 of grade separator 33. This insures that the bending of suspension flat 48 during insertion occurs at areas which are not unpredictably weakened by heat and also insures the highest possible uniformity in strength in the bending area. One suspension flat 48 is welded to each end of grade separator 33. Each grade separator/suspension flat assembly is manually placed over mold cover 47 so that grade separator 33 is placed in the center of the upper part of mold 45. This can be done during the time tundish 44 is replaced with a new tundish containing a different grade of molten steel.

As with the suspension bridge described in the preferred embodiment, bars 42 of T-shaped pushers 40 are fastened to pipes 37 of support brackets 36 which are attached to the bottom of tundish 44. As tundish 44 is lowered, T-shaped pushers 40 cause suspension flat 48 to bend. The bending of suspension flat 48 insures that grade separator 33 will be inserted uniformly and straight into mold 45. Clawed ends 49 of suspension flat 48 insure that suspension flat 48 will not fall into mold 45 and grade separator 33 will not be inserted into the mold to a depth deeper than the reach of pushers 40. Part of suspension flat 48 will melt in the mold and the remnants can be easily retrieved manually.

We claim:

1. In a continuous caster apparatus for the casting of molten steel, said apparatus having a tundish with means to attach bars to the bottom thereof, a mold capable of receiving a grade seperator used to separate different grades of molten steel poured into said mold, a grade separator, a mold cover, and a device for inserting said grade separator into said mold, said inserting device comprising:

(a) standard U-shaped channel having a hole in the base thereof;

(b) alignment plates which are welded to the outside of said base so as to permit said grade separator to be aligned in the center of said mold;

(c) a wire rope which is inserted through said hole in said base;

(d) means to clamp said wire rope to the inside of said base;

(e) guides for said wire rope; and (f) means to exert and control pressure on said wire rope.

2. A device according to claim 1 for inserting a grade separator into the mold of a continuous caster apparatus wherein said means to clamp said wire rope to the inside of said base comprises:

(a) two cylindrical bars which are welded to the inside of said base of said channel between which bars said wire rope is positioned;

(b) a pressure plate having two holes therein which is fitted onto said cylindrical bars so that said pressure plate is positioned immediately above said wire rope; and (c) an angle plate which is welded to the sides of said channel, said angle plate having an inverted U-shaped hole in its vertical side through which said wire rope is inserted and a round hold in its horizontal side.

3. A device according to claim 1 for inserting a grade separator into the mold of a continuous caster apparatus wherein said guides for said wire rope comprise:

(a) a cylindrical bar which is welded to said sides of said channel near said hole in said base of said channel over which bar said wire rope is positioned; and (b) two cylindrical bars which are welded to the inside of said base near one end of said channel between which bars said wire rope is positioned.

4. A device according to claim 2 for inserting a grade separator into the mold of a continuous caster apparatus wherein said means to exert and control pressure on said wire rope comprises:

(a) a nut attached to the underside of the top of said angle plate;

(b) a threaded bolt having a spring-loaded, nipple-shaped end, said bolt being inserted through said round hole in said top of said angle plate and threaded through said nut attached to the underside of said top of said angle plate so that when said bolt is turned in one direction, said nipple-shaped end will come into contact with said pressure plate, whereupon said nipple-shaped end will retract against the spring contained in said bolt and said pressure plate will slide down along said cylindrical bars causing pressure to be exerted on said wire rope and when said threaded bolt is turned in the opposite direction, said nipple-shaped end will elongate causing said pressure plate to slide up along said cylindrical bars and the amount of pressure on said wire rope to decrease; and (c) a nut having cylindrical bars welded thereto which is attached to the top of said threaded bolt to facilitate the turning of said threaded bolt.

5. In a continuous caster apparatus for the casting of molten steel, said caster having a tundish with means to attach bars to the bottom thereof, a mold capable of receiving a grade seperator used to separate different grades of molten steel poured into said mold, a grade separator, and a mold cover, a method for inserting said grade separator into said mold comprising the following steps:

(a) attaching an insertion means to each end of said grade separator, said insertion means having a wire rope capable of being attached to said grade separator and a means to exert and control pressure on said wire rope;

(b) adjusting the pressure exerted on said wire rope of each insertion means so as to allow said grade separator to be suspended under its own weight prior to its insertion into the molten steel in said mold and said wire rope to slip as said grade separator is inserted into said molten steel in said mold;

(c) attaching said bars, each of which has a cross-member attached perpendicularly to one end thereof, to the bottom of said tundish;

(d) manually placing said insertion means on said mold cover so that said grade separator is centered in the upper part of said mold; and (e) lowering said caster tundish so that said cross-members of said bars attached to the bottom of said tundish come in contact with said grade separator and force said grade separator into said molten steel in said mold.

6. In a continuous caster apparatus for the casting of molten steel, said apparatus having a tundish with means to attach bars to the bottom thereof, a mold capable of receiving a grade seperator used to separate different grades of molten steel poured into said mold, a grade separator, a mold cover and a device for inserting said grade separator into said mold, said inserting device comprising a sheet of flat carbon steel having its ends bent at right angles so as to allow said ends to grasp onto the top of said mold cover, said sheet of carbon steel being capable of bending when pressure is exerted thereon.

7. In a continuous caster apparatus for the casting of molten steel, said apparatus having a tundish with means to attach bars to the bottom thereof, a mold capable of receiving a grade separator used to separate different grades of molten steel poured into said mold, a grade separator, and a mold cover, a method for inserting said grade separator into said mold comprising the following steps:

(a) attaching an insertion means to each end of said grade separator, said insertion means comprising a sheet of flat carbon steel having its ends bent at right angles so as to allow said ends to grasp onto the top of said mold;

(b) attaching said bars, each of which has a cross-member attached perpendicularly to one end thereof, to the bottom of said tundish;

(c) manually placing said insertion means on said mold cover so that said grade separator is centered in the upper part of said mold and said ends of said insertion means lie on said mold cover; and (d) lowering said caster tundish so that said cross-members of said bars attached to the bottom of said tundish come in contact with said grade separator causing said insertion means to bend and said grade separator to be inserted into said molten steel in said mold.

8. In a continuous caster apparatus for the casting of molten steel, said apparatus having a mold capable of receiving a device used to separate different grades of molten steel poured into said mold, said device being commonly called a grade separator, a grade separator comprising:

(a) two end plates, each of which has two rows of holes therein, the distance between the center of one hole in the upper row of holes and the centers of two adjacent holes in the same row of holes being equal and the distance between the center of each hole in the lower row of holes and the centers of the two nearest holes in the upper row of holes being equal and the number of holes in said upper row being one greater than the number of holes in said lower row of holes; and (b) cylindrical bars inserted through said holes of each endplate and tack welded to each of said endplates.

* * * * *